US010829945B2

(12) United States Patent
Thorp

(10) Patent No.: US 10,829,945 B2
(45) Date of Patent: Nov. 10, 2020

(54) CONSTRUCTION ASSEMBLY

(71) Applicant: Tectonic Facades Limited, Chesterton, Newcastle under Lyme (GB)

(72) Inventor: Harvey Richard Thorp, Newcastle under Lyme (GB)

(73) Assignee: Tectonic Facades Limited, Staffordshire (GB)

( * ) Notice: Subject to any disclaimer, the term of this patent is extended or adjusted under 35 U.S.C. 154(b) by 106 days.

(21) Appl. No.: 16/093,136

(22) PCT Filed: Mar. 29, 2017

(86) PCT No.: PCT/GB2017/050823

§ 371 (c)(1),
(2) Date: Oct. 11, 2018

(87) PCT Pub. No.: WO2017/178786

PCT Pub. Date: Oct. 19, 2017

(65) Prior Publication Data

US 2019/0309533 A1 Oct. 10, 2019

(30) Foreign Application Priority Data

Apr. 11, 2016 (GB) ..... 1606084.0

(51) Int. Cl.
*E04G 15/04* (2006.01)
*B28B 23/02* (2006.01)
(Continued)

(52) U.S. Cl.
CPC ..... *E04G 15/04* (2013.01); *B28B 23/02* (2013.01); *E04B 1/41* (2013.01); *E04B 1/4114* (2013.01);
(Continued)

(58) Field of Classification Search
CPC ... E04G 15/04; E04B 1/41; E04B 1/08; E04B 1/4114; E04B 1/43; E04B 5/32;
(Continued)

(56) References Cited

U.S. PATENT DOCUMENTS 1,260,147 A * 3/1918 Cornuelle ..... B29C 33/123 249/91
3,803,784 A * 4/1974 Becker ..... E04C 2/52 52/405.3
(Continued)

FOREIGN PATENT DOCUMENTS

AT 313538 B * 2/1974 ..... E04F 13/0832
CA 2006818 A1 * 6/1990 ..... C07K 14/62
(Continued)

OTHER PUBLICATIONS

GB1606084.0, Examination Report dated Apr. 11, 2016, 3 pages.
PCT/GB2017/050823, International Search Report and Written Opinion, dated May 29, 2017, 11 pages.

*Primary Examiner* — Jeanette E Chapman
(74) *Attorney, Agent, or Firm* — Han Santos, PLLC

(57) ABSTRACT

A construction article 12 usable in the construction of a building made of concrete. The article 12 has base and side members 32, 34 in the form of plates extending perpendicularly from each other in an L-shape configuration. Three spaced upstanding elongate members 42 are provided upstanding from the base member 32. An appropriately shaped closure member 14 is provided which closes the open ends of the elongate members 42 such that when concrete is poured thereover the members 42 leave three openings extending through the set concrete to permit fixings to extend therethrough.

20 Claims, 11 Drawing Sheets

(51) Int. Cl.

| | |
|---|---|
| ***E04B 1/41*** | (2006.01) |
| ***E04F 13/08*** | (2006.01) |
| ***E04B 2/94*** | (2006.01) |
| *E04B 5/32* | (2006.01) |

(52) U.S. Cl.
CPC ..... *E04B 2/94* (2013.01); *E04F 13/0832* (2013.01); *E04B 5/32* (2013.01); *E04B 2103/02* (2013.01)

(58) Field of Classification Search
CPC ..... E04B 2103/02; E04B 1/16; B32B 23/02; E04F 13/0832
USPC ..... 52/576
See application file for complete search history.

(56) References Cited

U.S. PATENT DOCUMENTS

| | | | | |
|---|---|---|---|---|
| 5,937,609 | A | 8/1999 | Roth | |
| 8,915,038 | B1 * | 12/2014 | Whitcomb, Sr. | E04G 11/06 249/152 |
| 9,617,746 | B1 * | 4/2017 | Francies, III | E04G 21/142 |
| 9,683,367 | B1 * | 6/2017 | Ting | E04B 1/41 |
| 2007/0079565 | A1 | 4/2007 | Bahramian | |
| 2008/0222981 | A1 | 9/2008 | Gobbi | |
| 2012/0210656 | A1 * | 8/2012 | Martin Hernandez | E04B 5/32 52/125.1 |
| 2017/0241133 | A1 * | 8/2017 | Ting | E04B 2/967 |
| 2018/0258632 | A1 * | 9/2018 | Francies, III | E04B 1/483 |
| 2019/0119908 | A1 * | 4/2019 | Petricca | E04B 1/4114 |
| 2019/0309533 | A1 * | 10/2019 | Thorp | E04G 15/04 |

FOREIGN PATENT DOCUMENTS

| | | | | |
|---|---|---|---|---|
| CA | 3006818 | A1 * | 11/2018 | E04B 1/043 |
| CN | 1584262 | A | 2/2005 | |
| DE | 29611201 | U1 * | 9/1996 | E04B 1/41 |
| EP | 0070770 | A1 * | 1/1983 | E04G 15/061 |
| EP | 3009575 | A1 * | 4/2016 | E04B 1/043 |
| EP | 2937492 | B1 * | 11/2017 | E04B 1/41 |
| EP | 3543428 | A2 * | 9/2019 | E04G 11/365 |
| GB | 1102427 | A | 2/1968 | |
| GB | 2549275 | A * | 10/2017 | E04B 2/94 |
| WO | WO-2012110699 | A1 * | 8/2012 | E04B 1/41 |

* cited by examiner

CONSTRUCTION ASSEMBLY

This invention concerns a construction assembly, and particularly a construction assembly for providing a void in a component of a settable material, a method of forming a component of a settable material, and a method of constructing a building.

In one form of building construction, an open frame for instance of concrete or steel is provided with columns and cross members. Floor slabs, generally of concrete are provided extending between the cross members. The floor slabs are generally formed in situ by pouring concrete into a defined space and allowing the concrete to set. Metal reinforcing elements (Rebar) will usually be provided in the space prior to pouring of the concrete, to be incorporated thereinto.

On the outside of the building, cladding, which may be in the form of facade panels, will be mounted to extend between the columns and the floor slabs. Such panels require fixing for instance to the floor slabs to provide restraint i.e. correct spacing relative to the frame, and also load bearing on the frame.

To provide correct mounting of the panels, fixings are required to be securely mounted to the floor slabs in appropriate positions. One prior mounting system includes casting a channel in the floor slab. With this system a channel requires to be suspended in the defined space prior to pouring of the concrete, which involves additional work prior to pouring of the concrete. Also specific fixings are required for use with the channel which can be relatively expensive. Problems can however be encountered if the channel is not in a required location and/or orientation.

A further system is to drill holes in the floor slabs after formation. It is however generally undesirable to drill through floor slabs, and in many instances this may not be permitted in view of health and safety and/or structural considerations.

If accurate location of mounting holes cannot be assured, then it may be necessary to use relatively expensive and time consuming to use, adjustable fixings. A further problem with prior arrangements is that mounting of the fixings can conflict with the Rebar in the concrete, which can cause problems and may not be permissable.

According to a first aspect of the invention there is provided a construction assembly for providing a void in a component of a settable material, the construction assembly including a construction article which is locatable in a defined space to receive the settable material such that when the settable material sets to form the component, the construction article forms a part of the component, the construction article including a base member locatable to extend across a lowest part of the defined space, a side member extendible from an edge of the base member locatable to extend along a side edge of the defined space, a hollow elongate member upstanding from the base member such as to define an elongate opening in the component once the settable material is set, the construction assembly also includes a closure member selectively locatable over an open end of the hollow elongate member spaced from the base member to close the hollow elongate member until the settable material has set, the combined height of the hollow elongate member and closure member when located from said end of the hollow elongate member being at least equal to the height of the defined space.

The combined height of the hollow elongate member and closure member when located on the said end of the hollow elongate member may be substantially equal to the height of the defined space.

An opening may be provided through the base member aligned with the interior of the hollow elongate member.

A plurality of hollow elongate members may be provided extending from the base member and spaced from each other.

One or more formations may be provided on the construction article to retain the closure member in position on the construction article closing the end of the hollow elongate member or members. The formations may comprise tabs which may include an opening to enable a fastening means to extend therethrough to engage with the closure member.

The base member and side member may extend perpendicularly to each other.

A target or other symbol, marking or formation may be provided on the outside of the side member to enable the location of the construction article to be recorded. The target or other symbol, marking or formation may be provided centrally in the side member.

A formation may be provided in the base member to facilitate correct location of the construction article, and the formation may comprise an opening, which opening may have a cruciform profile, and may be provided centrally in the base member.

Openings may be provided in the base member and/or side member to facilitiate mounting of the construction article to formwork forming the defined space.

Markings, which may be in the form of notches, may be provided in side edges of the base member and/or side member to facilitate correct location of the constrution article, and the markings may be provided half way along respective side edges of the base member and/or side member.

The closure member may converge towards a side thereof which engages against the open end of the hollow elongate member.

The closure member may comprise a profiled member which closes the end of the one or more hollow elongate members upstanding from the base member The closure member may be profiled to extend from the side member to close the end of the one or more following elongate members. The closure member may extend from the side member at two spaced locations.

The closure member may be of substantially constant thickness.

The closure member may be made of wood or a plastics material.

The construction article may be made of metal, and may be made of stainless steel or galvanised steel.

According to a further aspect of the invention there is provided a method of forming a component of a settable material, the method including forming a defined space to receive a settable material, locating a construction assembly according to any of the preceding sixteen paragraphs in the defined space with the closure member located on the construction article, locating reinforcing elements in the defined space, filling the defined space with settable material, once the settable material has set, removing the closure member from the construction article.

The defined space may be formed by formwork, and the construction article may be mounted to the formwork prior to supply of settable material into the defined space.

According to a still further aspect of the invention there is provided a method of constructing a building, the method including forming a floor slab component by a method according to either of the above paragraphs, with at least two construction articles in the floor slab, mounting a fixing to each construction article, and mounting cladding to the fixing.

An embodiment of the present invention will now be described by way of example only and with reference to the accompanying drawings, in which:—

Figure 1:
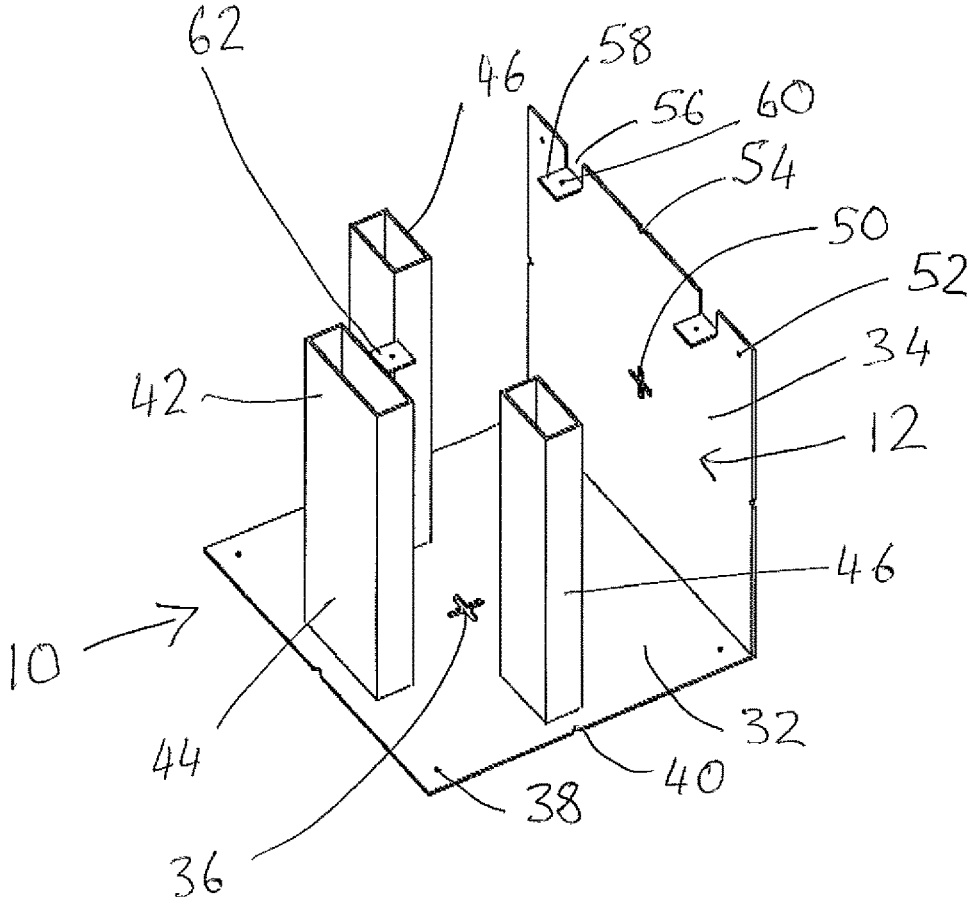
FIG. 1 is a diagrammatic perspective view from above of a construction assembly according to the invention.
Figure 2:
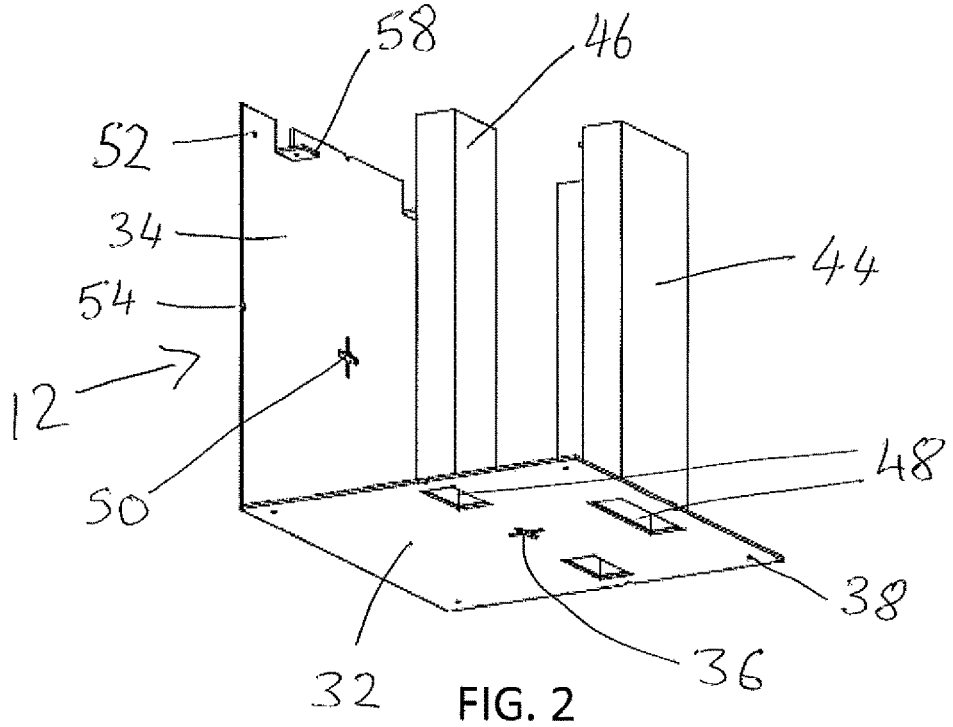
FIG. 2 is a diagrammatic perspective view from below of the assembly of FIG. 1.
Figure 3:
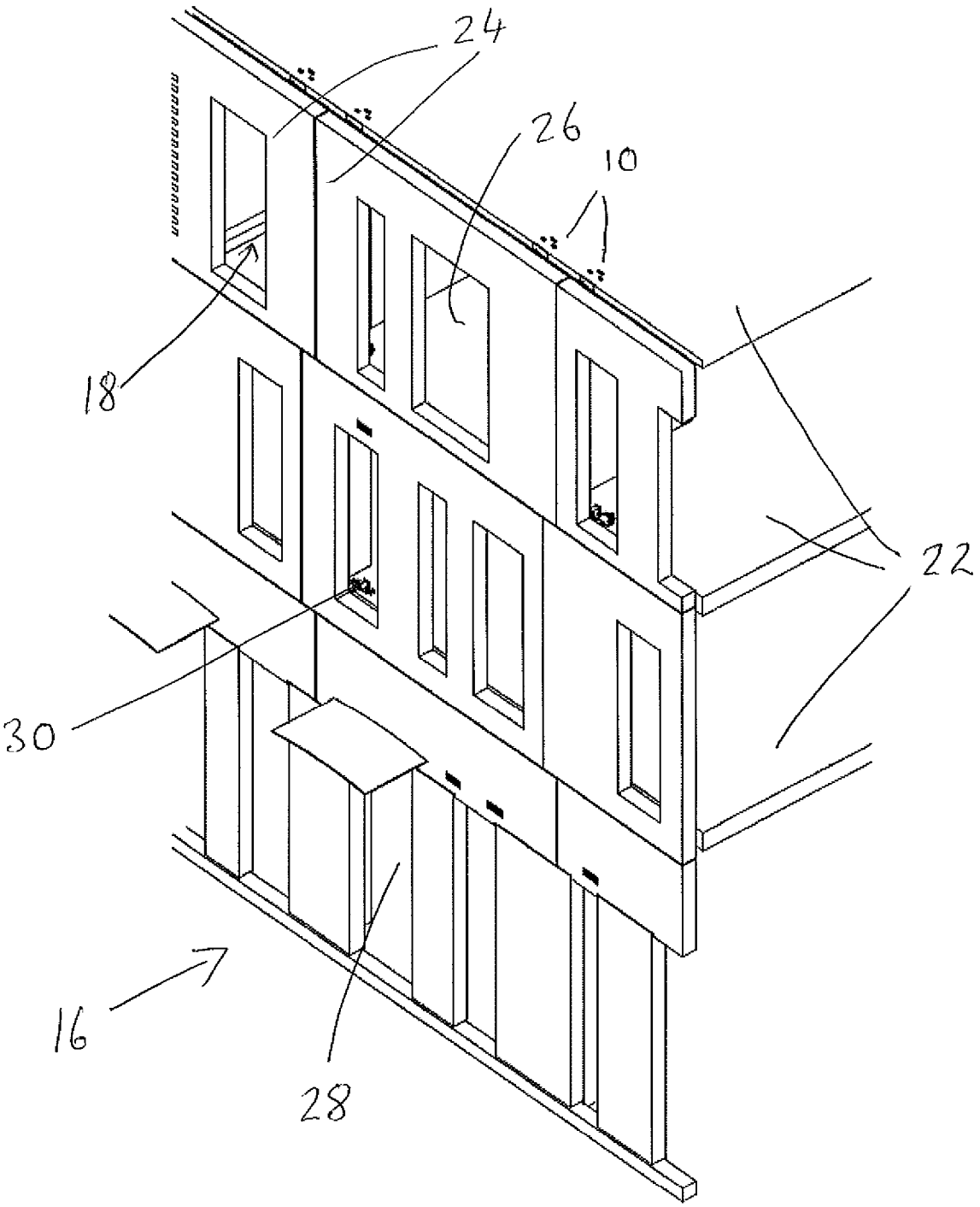
FIG. 3 is a diagrammatic front perspective view of a building formed incorporating the construction assembly of FIG. 1.

The drawings show a construction assembly 10 comprising a construction article 12 and a closure member 14. The construction assembly is usable in the construction of a building 16 as diagrammatically shown in FIG. 3 and other figures. The building 16 has a concrete frame 18 with a plurality of columns 20. Cross members (not shown) extending between the columns 20 are provided, which cross members would generally comprise pre cast floor slabs.

A plurality of concrete floor slabs 22 are provided extending between the columns 20, which slabs 22 will be formed in situ. Provided on the outside of the building 16 are a plurality of panels in the form of facades 24 extending between the columns 20. The facades may provide windows 26 and/or doors 28 as illustrated. Fixings 30 are provided to mount the facades 24 to the floor slabs 22 and to provide restraint and load bearing of the facades 24.

In this instance a pair of fixings 30 are provided on each floor slab 22 adjacent respective columns 20 for mounting each facade 24, but different mounting arrangements can be provided as required.

Each construction article 12 comprises a base member 32 in the form of a plate, with a side member 34 also in the form of a plate, extending perpendicularly from one edge of the base member 32. The base member 32 is square and has a central cruciform opening 36 to permit correct location of the construction article 12. The cruciform opening 36 can be aligned with an appropriate grid or markings. A mounting hole 38 of a size to permit a nail to pass through, is provided adjacent each corner of the base member 32. Notches 40 are provided on the three side edges of the base member 32 which do not meet with the side member 34, and the notches 40 are provided centrally to enable the centre of the base member 32 to be correctly aligned.

Three rectangular cross section hollow tubular upstanding elongate members 42 are provided upstanding from the base member 32, one 44 centrally towards the edge of the base member 32 away from the side member 34, and the other two 46 either side of the cruciform opening 36. Each of the elongate members 42 is aligned with a longer direction parallel to the side member, and as shown the one elongate member 44 extends for a greater distance in the longer direction than the other elongate members 46. Corresponding openings 48 are provided through the base member 32 such that the elongate members 42 define open hollow channels.

The side member 34 is provided with a similar central opening 50, mounting holes 52 and notches 54. Two rectangular recesses 56 are formed in the top edge of the base member towards each end thereof by a cut out portion being bent downwardly to define a flange 58 with a through mounting hole 60. A similar flange 62 is provided on the inner side of the one elongate member 44 spaced from the top thereof to provide three equal height mounting flanges 58, 62.

Figure 5:
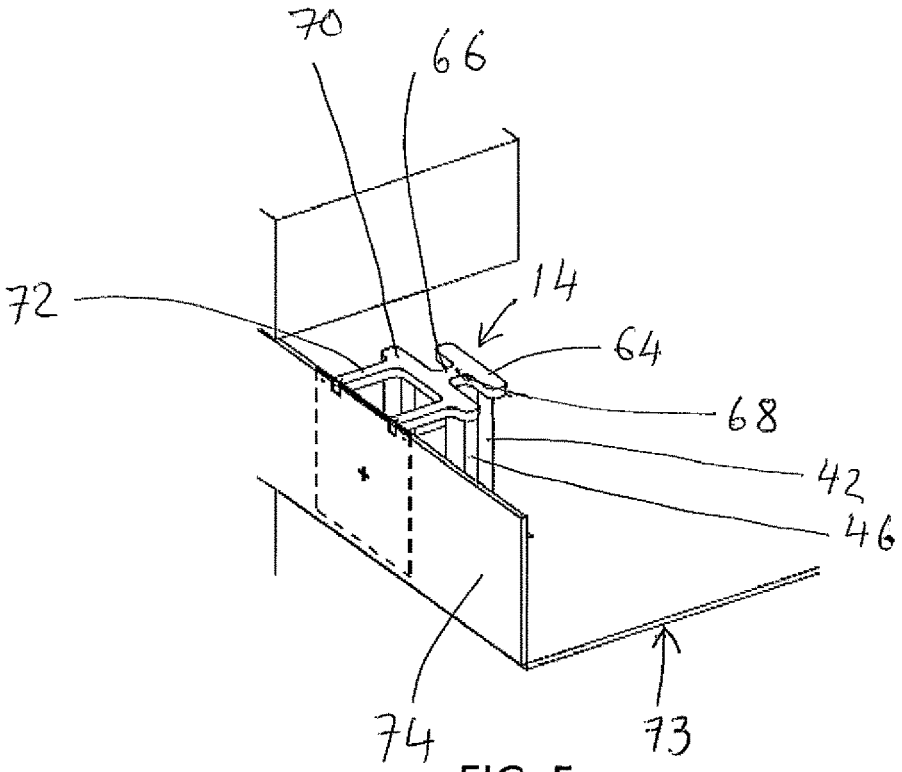
FIG. 5 is a more detailed diagrammatic view of part of FIG. 4.

The closure member 14 comprises a profiled piece of constant thickness wood, with a first transverse part 64 of a size to fully cover the top of the one elongate member 44 and extend laterally therebeyond on each side. A web 66 extends from the first part 64 with a hole 68 there trough to locate a screw to engage in the hole in the flange 62 on the one elongate member 42. The web 66 connects to a second longer cross part 70 which is of a size and location to extend between, and a little beyond each of the two other elongate members 46 and close same. Two longer webs 72 extend from the second cross part 70 towards ends thereof so as to when located on the construction article 12, locate on the flanges extending from the side member. Again holes are provided towards the end of the longer webs to permit mounting to the flanges 58 extending from the side member 34. FIG. 5 for instance shows the closure member 14 mounted on the construction article 12.

Figure 4:
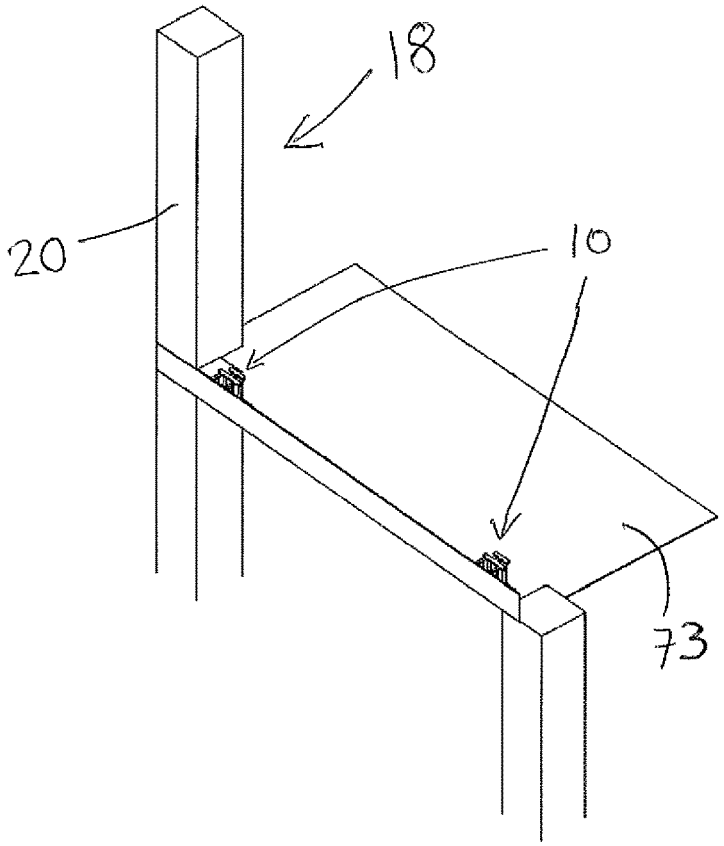
FIG. 4 is a diagrammatic front perspective view of the construction assembly of FIG. 1 being used in construction of the building of FIG. 3.

A floor slab 22 can be formed as follows. A defined space is provided by appropriate formwork 73 which may for instance be plywood or other wood. As can be seen for instance in FIGS. 4 and 5 a side edge 74 to the formwork 73 is provided which will define the front edge of the floor slab 22. Two construction assemblies 10 are mounted to the formwork 73 in required positions adjacent respective columns 20, with the side members 34 engageable against the side edge 74 and being mounted thereto by nails passing through the holes 52. The base member 32 is also mounted to the respective part of the formwork 73 by nails passing through the respective holes 38. As shown the closure member 14 is mounted on the construction article 12.

Figure 6:
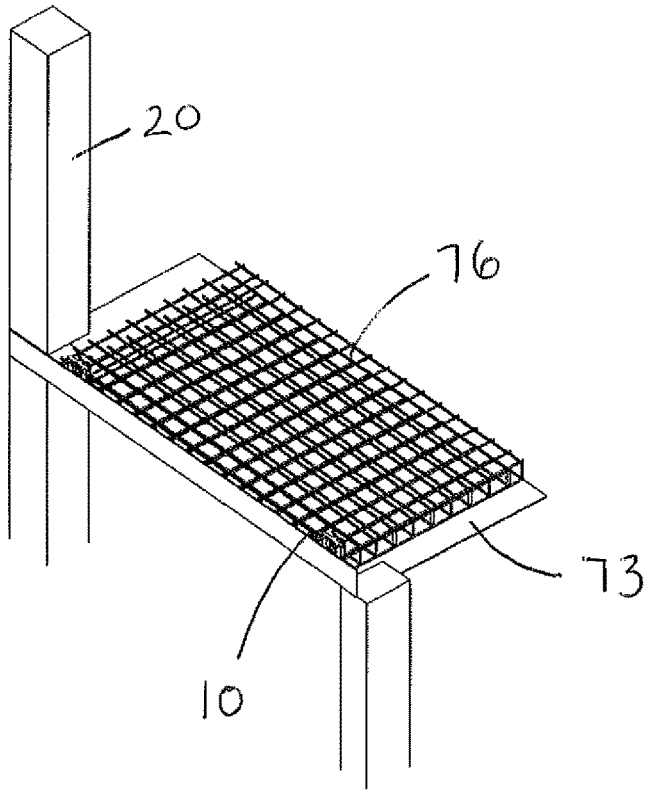
FIGS. 6 and 7 are similar views respectively to FIGS. 4 and 5 further on in the construction of the building.
Figure 7:
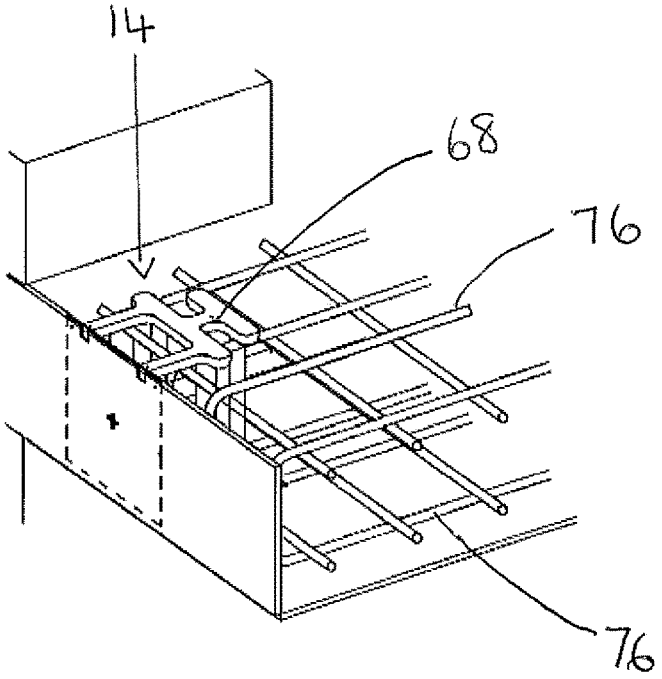
Figure 8:
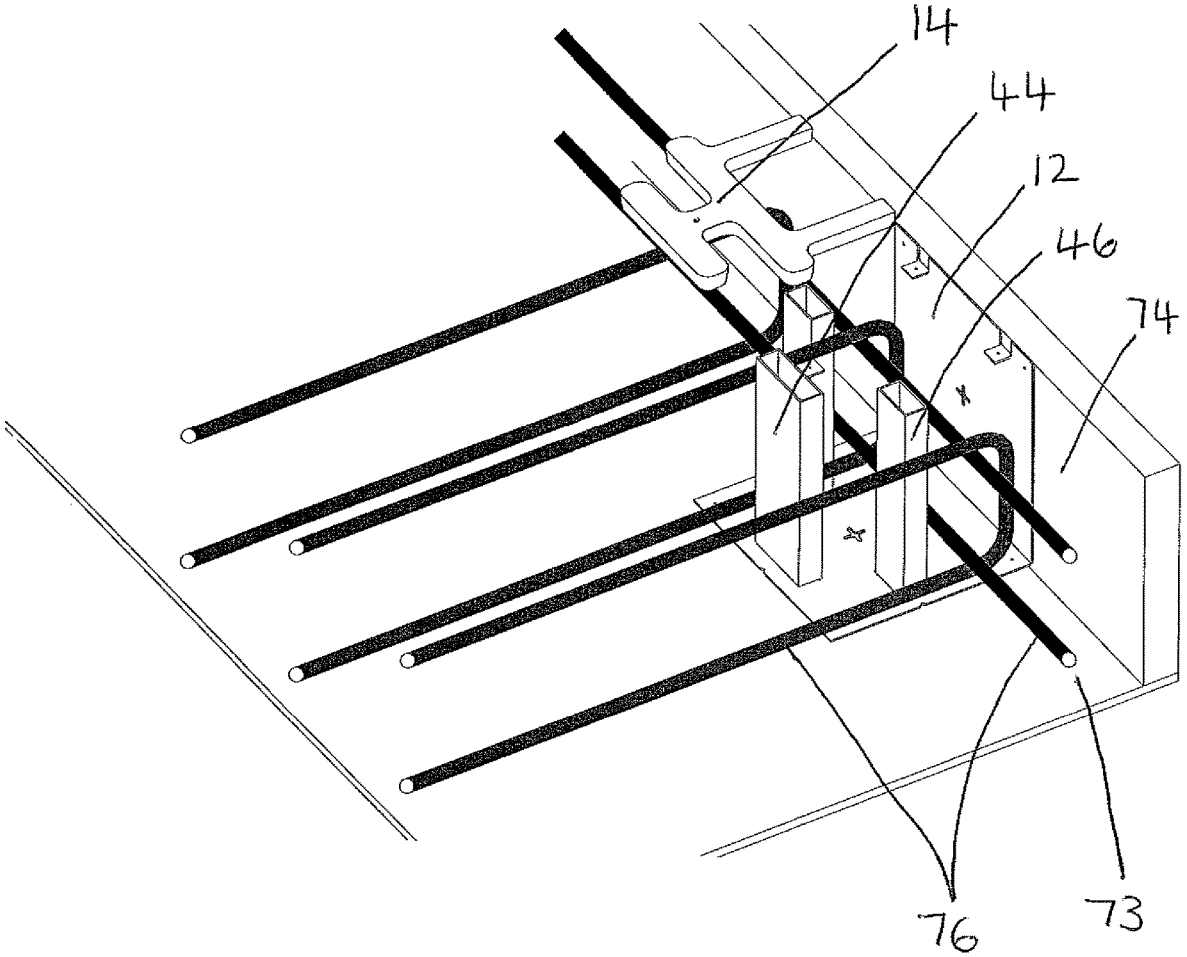
FIG. 8 is a generally similar view to FIG. 7 but in a reverse direction and in an exploded format.

Reinforcement in the form of a framework 76 of steel bars (Rebar) is located in the space defined by the formwork 73, as shown in FIGS. 6 and 7. As the construction assemblies 10 are located prior to location of the reinforcement framework 76, the reinforcement will not interfere with the construction articles 12 and particularly the elongate members 44, 46. Concrete is then poured into the space defined by the formwork 73 and allowed to set.

Figure 9:
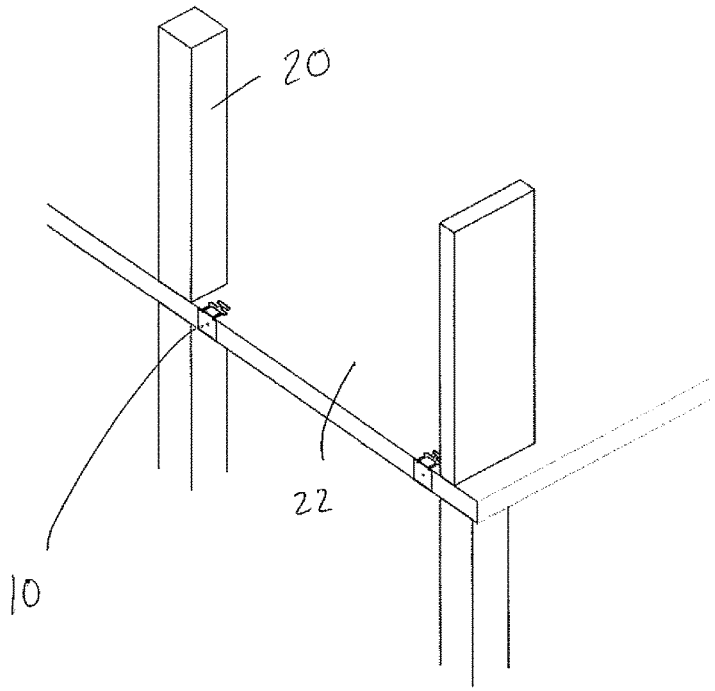
FIGS. 9 and 10 are similar views respectively to FIGS. 4 and 5 but still further on during the construction of the building.
Figure 10:
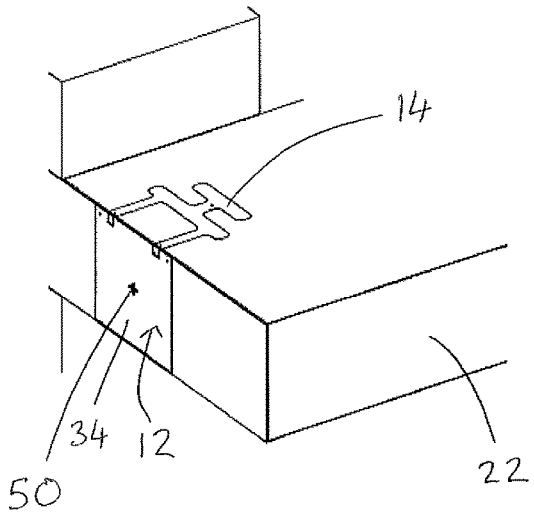
Figure 11:
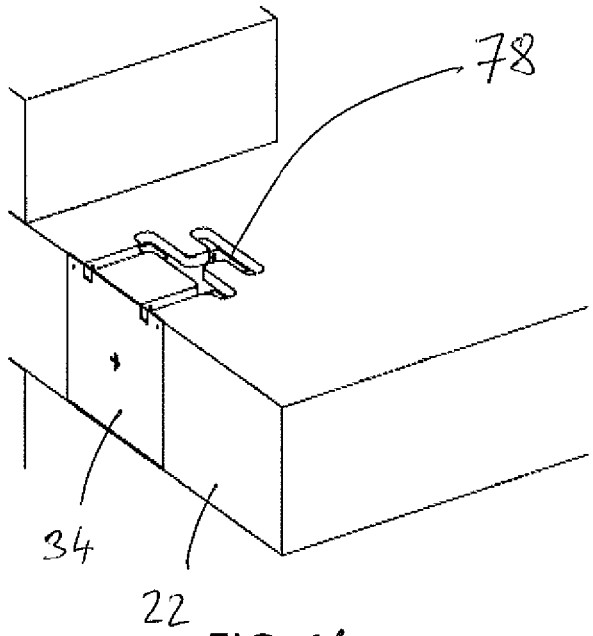
FIGS. 11-15 are similar views to FIG. 10, sequentially showing mounting of a fixing to the construction assembly of FIG. 1.
Figure 12:
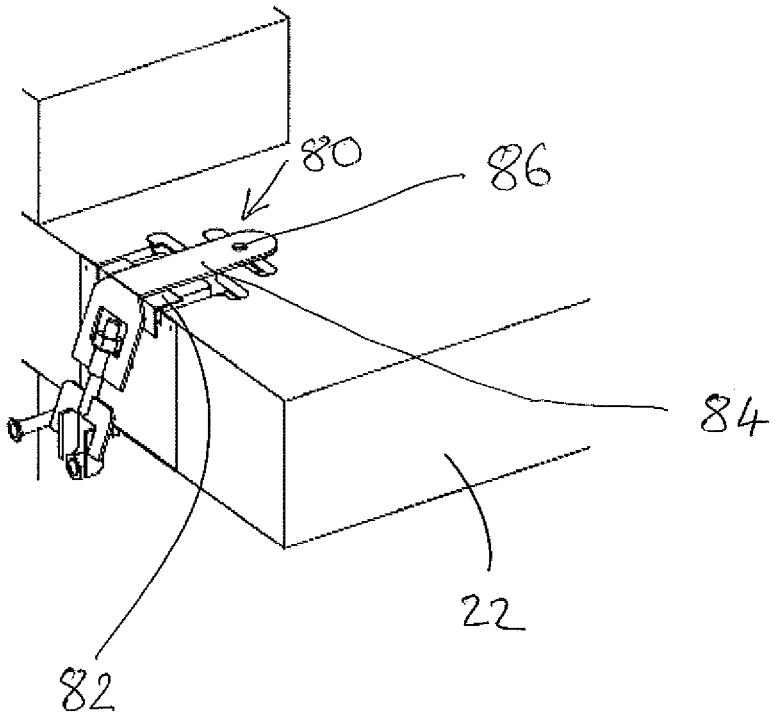
Figure 13:
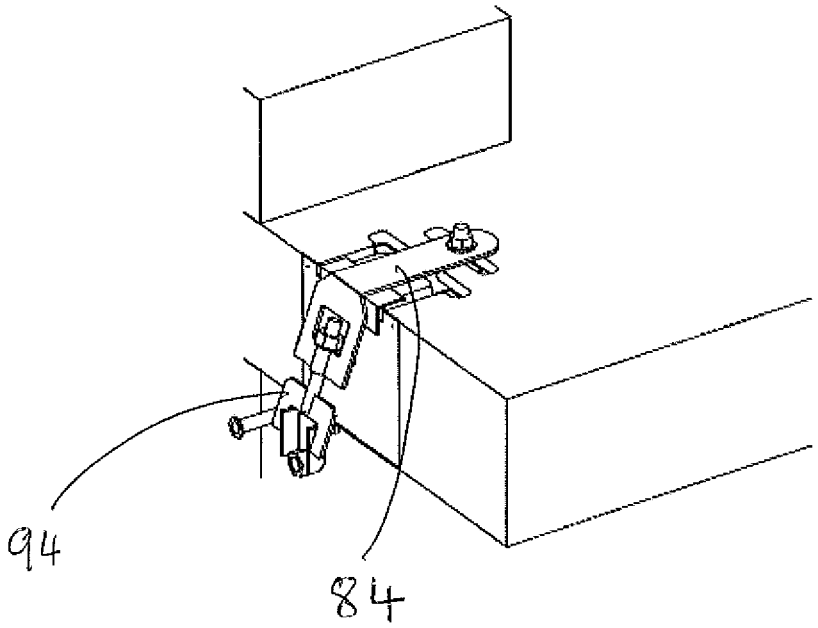
Figure 14:
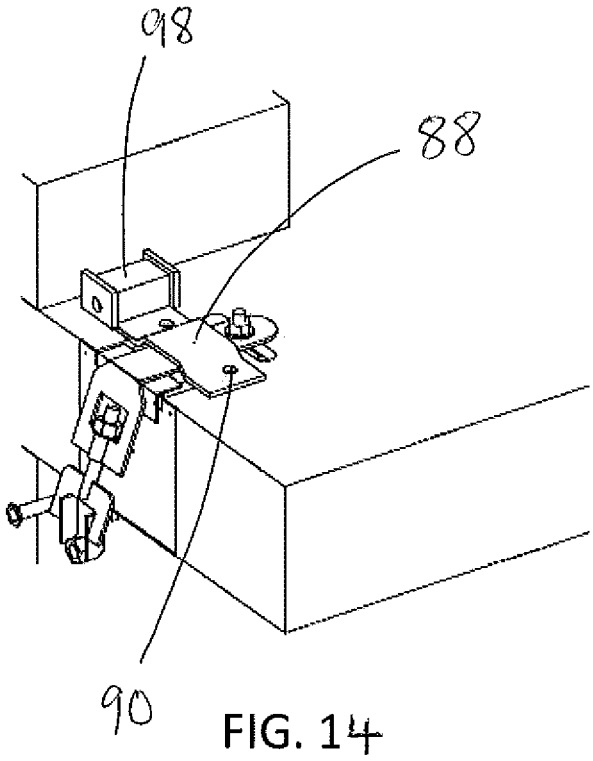
Figure 15:
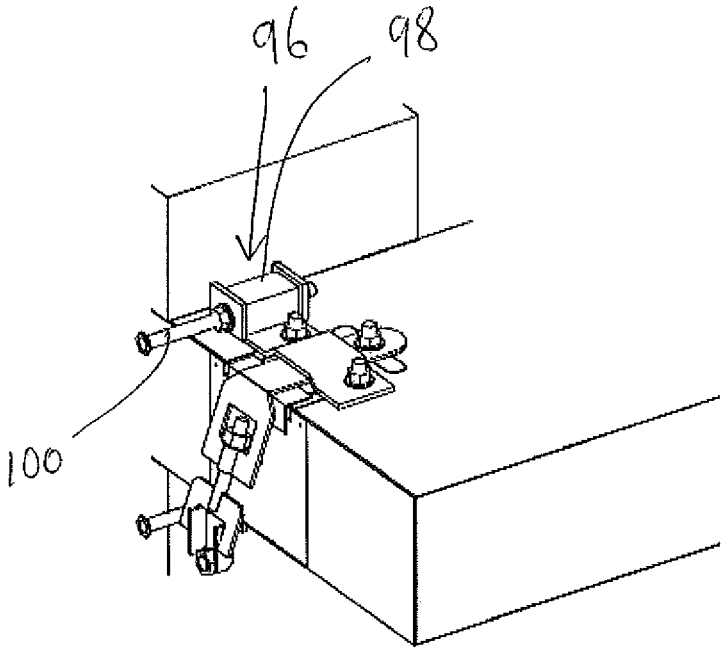

The formwork 73 can then be removed to provide the arrangement shown in FIGS. 9 and 10. The opening 50 on the side member provides a data marking, which could for instance be detected by a theodolite or otherwise to provide an indication of the required positioning of fixings on cladding or otherwise. The closure member 14 can now be removed from the concrete, and the closure member 14 converges gently downwardly in use to facilitate its removal. Removal of the closure member 14 leaves a profiled void 78 in the surface of the top of the floor slab 22, which void 78 connects to the three openings extending through the floor slab 22, defined by the elongate members 44, 46.

As shown in FIGS. 12-15 a fixing arrangement 80 can now be mounted to each of the construction assemblies 10. The fixing arrangement 80 is located against an L-shape protection member 82 to prevent the fixing arrangement 80 damaging the edge of the floor slab 22, or vice versa. The fixing arrangement 80 includes a longitudinal member 84 with a through hole 86, which hole 86 is locatable over the opening defined by the one elongate member 42. The distance of the opening defined by the one elongate member 42 to the edge of the floor slab 22 is defined by the construction article 12. As the opening defined by the one elongate member 42 is transversely elongate, this permits some lateral tolerence in mounting.

An appropriate fastening comprising for instance a length of threaded bar and appropriate nuts or other fastenings can extend through the opening defined by the one elongate member 42 to mount the longitudinal member 84 to the construction assembly 10. The fixing arrangement 80 also includes a transverse member 88 with two mounting holes 90 which can be similarly mounted to the openings provided by the two elongate members 46. Extending downwardly from the end of the longitudinal member 82 by the edge of the floor slab 22 is a mounting configuration 94 for fixing to a facade 24 to bear the weight of the facade 24.

Provided on one end of the transverse member 88 is an adjustable restraining part 96 with a body 98 and an adjustable elongate member 100 extending therefrom to provide restraining mounting of the facade 24, to provide correct positioning of the facade 24 relative to the frame 18.

Figure 16:
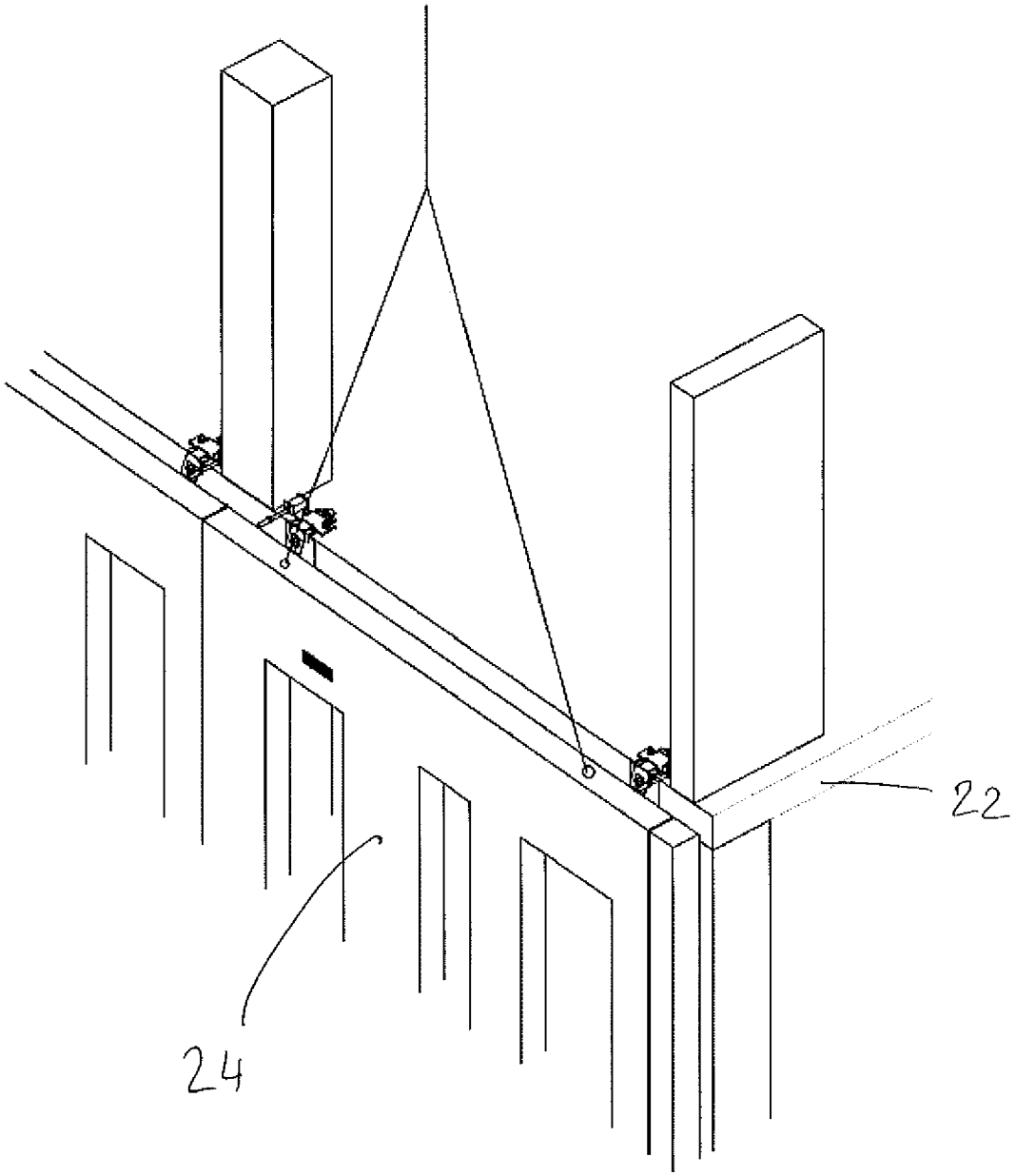
FIG. 16 is a similar view to FIG. 9 but showing a panel being mounted to fixings as shown in FIGS. 11-15.

FIG. 16 shows a facade 24 being lifted into position to enable connection to the mounting configurations 94. Once the mounting has been completed, the profiled recess 78 in the top of the floor slab 22 is filled with a grout to provide a level upper surface of the floor slab 22, prevent water ingress, and retain everything in place.

There is thus described a construction assembly which permits ready and accurate mounting of facades to floor slabs. The construction assembly is formed so as to provide the required correct spacing of the various components and ensures that the openings provided by the elongate member are correctly aligned relative to each other and also the edge of the floor slab. As the assembly is already formed, significantly less input is required than with previous systems by persons involved in the building construction. This reduces the amount of assembly work required, and also the chances of incorrect mounting which otherwise could lead to significant delays and costs during building construction.

It is to be realised that such assemblies can be formed to be bespoke for particular situations and fittings. Also providing the target on the construction article means that once fitted, the assemblies can be accurately located for instance by a survey or otherwise to ensure that the facades will fit correctly when brought into place.

As the assemblies are located in place prior to the reinforcement, this ensures there is no interference between the reinforcement and the fixing of the facades. As through holes are provided through the floor slabs, if the holes did become filled with concrete, this could readily be removed by drilling The depth of mounting, and also the mounting distance from the edge of the floor slab are fixed, but a certain amount of lateral tolerence is provided to ensure that usual tolerences can be accounted for. As indicated with the closure member on the construction article, the top of the closure member will be substantially flush with the top surface of the floor slab. This means that the construction assembly does not hinder operations or cause an obstruction, and this also means that damage thereto in use is unlikely.

Figure 17:
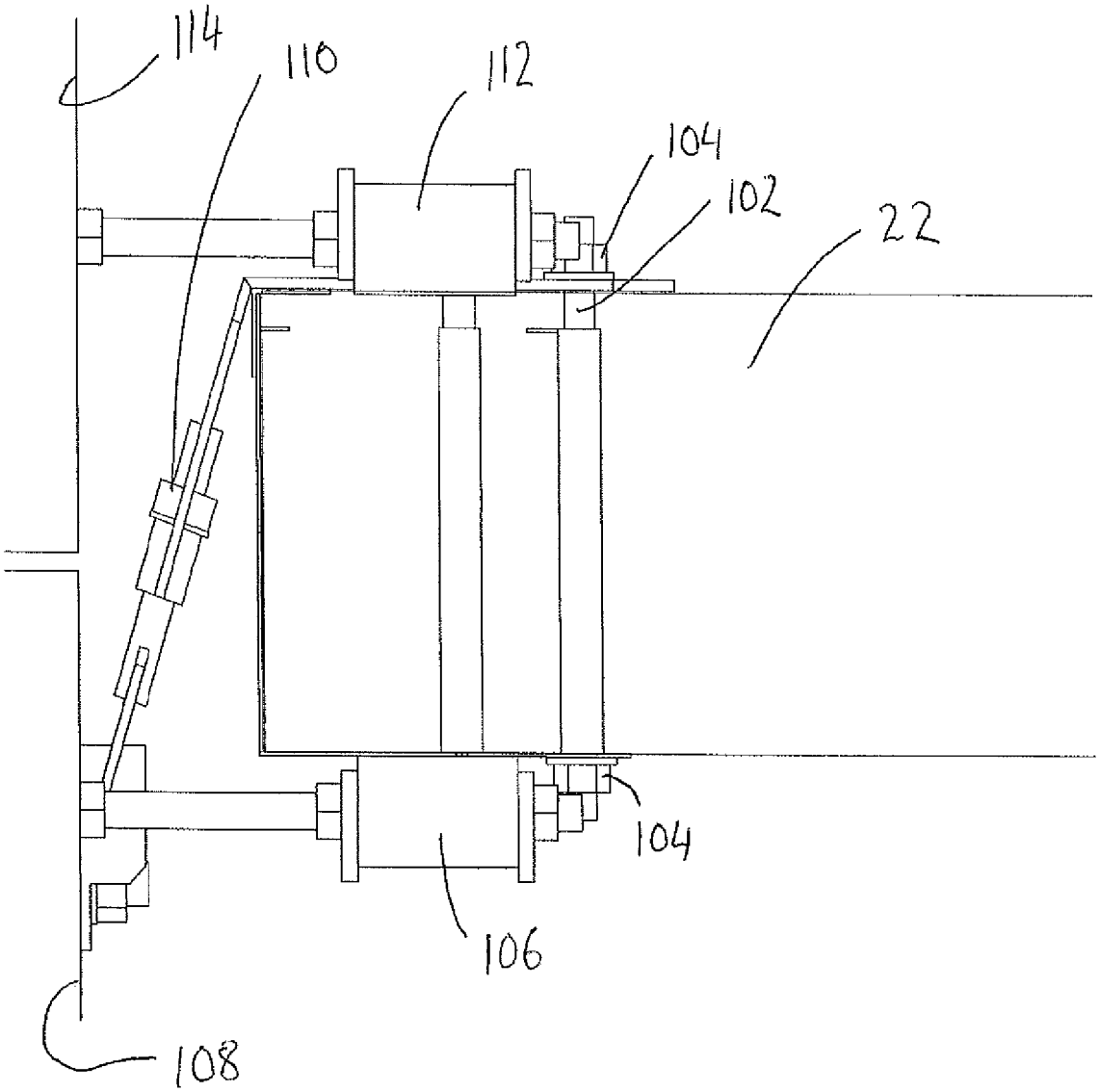
FIG. 17 is a diagrammatic cross sectional side view illustrating use of a construction assembly according to the invention.

As is shown in FIG. 17 the through holes in the floor slabs 22 mean that a single bolt 102 can extend wholly therethrough, with nuts 104 or other mountings provided at each end. This also means that as well as fixing arrangements being mounted on top of the floor slabs as described above, fixing arrangements can be mounted to the underside of the floor slabs. For instance as shown, a fixing arrangement 106 can be mounted to the underside of a floor slab 22 to restrain a hung facade 108, i.e. retain the facade 108 in a required position. A fixing arrangement 110 mounted to the top of the floor slab 22 can hang the façade 108, and a further fixing arrangement 112 mounted to the top of the floor slab 22 can also restrain a facade 114 hung from a higher floor slab.

The above example describes floor slabs being cast in situ. At least some of the floor slabs may though be pre cast off site, with the construction assemblies again incorporated in the floor slabs during casting. The floor slabs may have 'downstands' or 'upstands', i.e. downwardly or upwardly extending areas at their edges of increased depth, and the construction assemblies could be provided at such areas. Construction assemblies according to the invention could be mounted to beams rather than floor slabs, as and when required.

Whilst the above described example discloses using the construction assembly to mount a facade on a building, it is to be realised that the construction assemblies can also be used in temporary engineering activities during construction of a building. For example the assemblies may be used to mount edge protection such as hand rails or screens. The assemblies can also be used to mount items such as hoist ties, protection fan assemblies, external access tie positions, and temporary running lines for workers to clip to when for instance mounting other facade elements such as glazing.

It is to be realised that a range of modifications may be made without departing from the scope of the invention. As indicated the assembly may be bespoke for particular situations, and this may require a different number and/or positioning of openings and hence elongate members. Whilst a hole is provided in the side member of the construction article, a different marking or target could be used, which could for instance be adhered to the construction article.

The closure member may take a different form, and could be differently mounted to the construction article. The closure member could for instance be made of a plastics material or other material, and may include formations which provide for mounting to the construction article. A handle or other formation could be provided on the closure member to facilitate removal thereof once the floor slab is formed.

The shape of the openings could be different. In this instance the construction article is made from steel which may be stainless steel or galvanised steel, but different materials could be used. The construction article and/or closure member may take a different form and could for instance provide a recess in the edge of the floor slab to receive part of a fixing.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A construction assembly for providing a void in a component of a settable material, the construction assembly comprising:

a construction article which is locatable in a defined space to receive the settable material such that when the settable material sets to form the component, the construction article forms a part of the component, the construction article including:

a base member locatable to extend across a lowest part of the defined space;

a side member extendible from an edge of the base member locatable to extend along a side edge of the defined space; and at least one hollow elongate member upstanding from the base member such as to define an elongate opening in the component once the settable material is set; and a closure member selectively locatable over an open end of a hollow elongate member spaced from the base member to close the hollow elongate member until the settable material has set.

2. The construction assembly according to claim 1, wherein a combined height of the hollow elongate member and the closure member when located from the open end of the hollow elongate member is equal or substantially equal to a height of the defined space.

3. The construction assembly according to claim 1, wherein the at least one hollow elongate member includes a plurality of hollow elongate members extending from the base member and spaced from each other.

4. The construction assembly according to claim 1, further comprising one or more formations on the construction article to retain the closure member in position on the construction article and closing an end of the at least one hollow elongate member, wherein the one or more formations comprise tabs, the tabs including an opening to enable a fastener to extend therethrough to engage with the closure member.

5. The construction assembly according to claim 1, wherein the base member and the side member extend perpendicularly to each other.

6. The construction assembly according to claim 1, further comprising a target, a symbol, a marking, or a formation on an outside of the side member to enable a location of the construction article to be recorded, the target, the symbol, the marking, or the formation being provided centrally on the side member.

7. The construction assembly according to claim 1, wherein the base member includes a formation to facilitate correct location of the construction article, the formation comprising an opening that has a cruciform profile and is located centrally in the base member.

8. The construction assembly according to claim 1, wherein at least one of the base member or the side member includes openings to facilitate mounting of the construction article to a formwork forming the defined space.

9. The construction assembly according to claim 1, wherein at least one of the base member or the side member includes side edges provided with markings in form of notches to facilitate correct location of the construction article.

10. The construction assembly according to claim 9, wherein the markings are provided half way along respective side edges of the at least one of the base member or the side member.

11. The construction assembly according to claim 1, wherein the closure member converges towards a side of the closure member that engages against the open end of the hollow elongate member.

12. The construction assembly according to claim 1, wherein the closure member comprises a profiled member that closes an end of the at least one hollow elongate member upstanding from the base member.

13. The construction assembly according to claim 12, wherein the closure member is profiled to extend from the side member to close the end of the at least one hollow elongate member.

14. The construction assembly according to claim 13, wherein the closure member extends from the side member at two spaced locations.

15. The construction assembly according to claim 1, wherein the closure member has a substantially constant thickness.

16. The construction assembly according to claim 1, wherein the closure member is made of wood or a plastics material.

17. The construction assembly according to claim 1, wherein the construction article is made of metal, stainless steel, or galvanised steel.

18. A method of forming a component of a settable material, the method including:

forming a defined space to receive a settable material;

locating a construction article in the defined space, the construction article including a base member locatable to extend across a lowest part of the defined space, a side member extendible from an edge of the base member locatable to extend along a side edge of the defined space, and a hollow elongate member upstanding from the base member such as to define an elongate opening in the component once the settable material is set;

locating a closure member on the construction article and over an open end of the hollow elongate member spaced from the base member to close the hollow elongate member, a combined height of the hollow elongate member and the closure member when located from the open end of the hollow elongate member being at least equal to a height of the defined space;

locating reinforcing elements in the defined space;

filling the defined space with settable material; and removing the closure member from the construction article once the settable material has set.

19. The method according to claim 18, wherein the defined space is formed by a framework, and the construction article is mounted to the framework prior to supply of settable material into the defined space.

20. A method of constructing a building, the method including:

forming a floor slab that includes a plurality of construction articles, the forming comprising:

forming a defined space to receive a settable material;

locating each construction article of the plurality of construction articles in the defined space, each construction article including a base member locatable to extend across a lowest part of the defined space, a side member extendible from an edge of the base member locatable to extend along a side edge of the defined space, and a hollow elongate member upstanding from the base member such as to define an elongate opening in the floor slab once the settable material is set;

locating a closure member on each construction article and over an open end of each hollow elongate member spaced from each base member to close each hollow elongate member, a combined height of each hollow elongate member and a corresponding closure member when located from a corresponding open end of a corresponding hollow elongate member being at least equal to a height of the defined space;

locating reinforcing elements in the defined space;

filling the defined space with settable material; and removing a corresponding closure member from each construction article once the settable material has set; and mounting a fixing to each construction article of the plurality of construction articles; and mounting cladding to each fixing.

* * * * *